US005926954A

United States Patent [19]

Wolf et al.

[11] Patent Number: 5,926,954

[45] Date of Patent: Jul. 27, 1999

[54] METHOD OF MAKING A SILENCER

[75] Inventors: Jerry M. Wolf, Powell; Hiten T. Shah, Delaware, both of Ohio

[73] Assignee: Acoust-A-Fiber Research & Development, Inc., Delaware, Ohio

[21] Appl. No.: 08/926,933

[22] Filed: Sep. 10, 1997

[51] Int. Cl.[6] ..... B23P 15/00

[52] U.S. Cl. ..... 29/890.08; 29/890.053

[58] Field of Search ..... 29/890.08, 890.053, 29/890.141, 445

[56] References Cited

U.S. PATENT DOCUMENTS

| | | | |
|---|---|---|---|
| 4,569,471 | 2/1986 | Ingemansson et al. . | |
| 4,774,985 | 10/1988 | Broadbelt et al. . | |
| 5,398,407 | 3/1995 | Stuer | 29/890.08 |
| 5,461,777 | 10/1995 | Ikeda et al. . | |
| 5,479,706 | 1/1996 | Tamano et al. . | |
| 5,784,784 | 7/1998 | Flanigan et al. | 29/890.08 |

FOREIGN PATENT DOCUMENTS 0692 616 A1 1/1996 European Pat. Off. .

OTHER PUBLICATIONS

Owens Corning, Glass Roving Filled Muffler Technology (RFMT), Pamphlet.

Werner Müller & Roland Rilling, Air Jet Texturing, Catalog, 1995, pp. 1–44, 91 and 92, Germany.

Jürgen Schell & Detlef Schell, Air Texturizing, Catalog, pp. 1–16, Germany.

Dietze & Schell, Machines For The Glass Fibre Industry, Catalog, pp. 1–13, Germany.

*Primary Examiner*—I Cuda

*Attorney, Agent, or Firm*—Kremblas, Foster, Millard & Pollick

[57] ABSTRACT

A silencer and method of making are described. A tube is wrapped with a layer of texturized fiber yarn. A septum is then overlaid. Other layers of fiber and septums may also be added. Once rolling is completed, the roll is placed in a canister with end caps.

9 Claims, 6 Drawing Sheets

METHOD OF MAKING A SILENCER

FIELD OF THE INVENTION

This invention relates generally to a silencer and the method of making it. Most particularly this relates to a silencer which uses a texturized fiberglass yarn and a septum instead of the previously used products within the silencer.

DESCRIPTION OF THE RELATED ART

Many types of silencers have been used in the past. The most common type of silencer used today is a muffler. Mufflers can come in a variety of shapes and sizes and each car manufactured today has one or more of them within the exhaust system. The muffler serves to reduce the noise which is inherently produced in exhausting hot gases into the atmosphere. A commonly used muffler incorporates one or more pipes through a canister. The pipe is typically perforated such that gas may pass from the interior of the pipe into the canister. The pipe is typically wrapped with a steel wool or with stainless steel wool further wrapped with insulation. The insulation material has a tendency to blow out when placed under heat and air pressure over an extended period of time. When it blows out, the acoustics and the performance of the muffler will change and make the muffler unsuitable for further use in the car, requiring replacement. The frequent replacement of mufflers can be prevented by using different materials.

Other types of more recently produced silencers incorporate a fiberglass yarn blown into the canister once all the pipes are in place. The primary problem with this method of making a silencer and the silencer made from the process is that the blowing in of the fibers cannot be done consistently from muffler to muffler. The fiber distribution using the blown process can vary from muffler to muffler causing changes in acoustical performance. The heaviest density using the blown yarn process is limited to up to 80–100 $kg/cm^3$.

Others have used fiberglass mats instead of fiberglass yarn and have wrapped the fiberglass mat around the perforated pipe. The problem with the fibers used in mats is that the fibers used in mats are short (about 1"–4" long), thereby disintegrating and blowing out due to exhaust heat and vibration.

These prior art devices and methods do provide some measure of silencing activity on a car. However, applicant has developed an improved process for making a silencer and an improved silencer resulting from the process.

SUMMARY OF THE INVENTION

The present invention is designed to overcome the problems inherent in the prior art products. The present invention contemplates a silencer which includes a canister, a perforated tube in the canister, the perforated tube having been wrapped with a layer of texturized fiber and at least one septum. The texturized fiber may be either texturized fiberglass or texturized basalt wool. The texturized fiber is wrapped according to conventional principles around the perforated tube. The wrapping process is then stopped and a septum is placed on top of the first layer of wrapped fiber. The septum is a thin, flat piece of material whose properties in sound deadening are well known. The septum may be one of a variety of materials but should come from the group which includes e-glass, ecr-glass, fiberglass, stainless steel wool or perforated foil, ceramic paper, basalt paper, vermiculite paper, or a composite basalt and fiberglass.

The septum is inserted on top of the texturized fiber yarn which has been wrapped around the perforated tube. The septum may cover the entirety of the wrapped tube or only a portion. The winding procedure is then restarted and a second layer of texturized fiber is laid on top of the septum. The process may be stopped and started several times and may place any number of texturized fiber and septums limited only by the size of the canister and the size of the location in which the canister is to be placed in a vehicle. It is also noted that instead of there being one septum placed on the texturized fiber when the wrapping procedure is stopped, two septums may be placed on the texturized fiber covering either a part or the entirety of the wrapped tube.

The silencer according to the present invention incorporates the best portions of previous silencers. The silencer is wrapped with the texturized fiber to achieve a uniform density which is quite flexible in amount. The sound absorbing qualities of fiberglass and basalt wool are also well known. The use of the fiberglass or basalt wool will also allow a greater range of temperature that the silencer will withstand prior to fibers blowing out. The use of the wrapping and the septums will also allow a consistency between silencers made according to the same process. The new method also allows for flexibility in the wrapping pattern and density, thereby allowing volumetric air flow resistance and fine-tuned acoustical performance. This will permit anyone using the process to precisely tune mufflers such that the multiple possible mufflers on a car may be tuned to each other. Thus, the silencer will perform better and more consistently than any previous silencer.

BRIEF DESCRIPTION OF DRAWINGS

FIG. 11 is a side view of the completed silencer with the end caps on.

DESCRIPTION OF THE PREFERRED EMBODIMENTS

Figure 1:
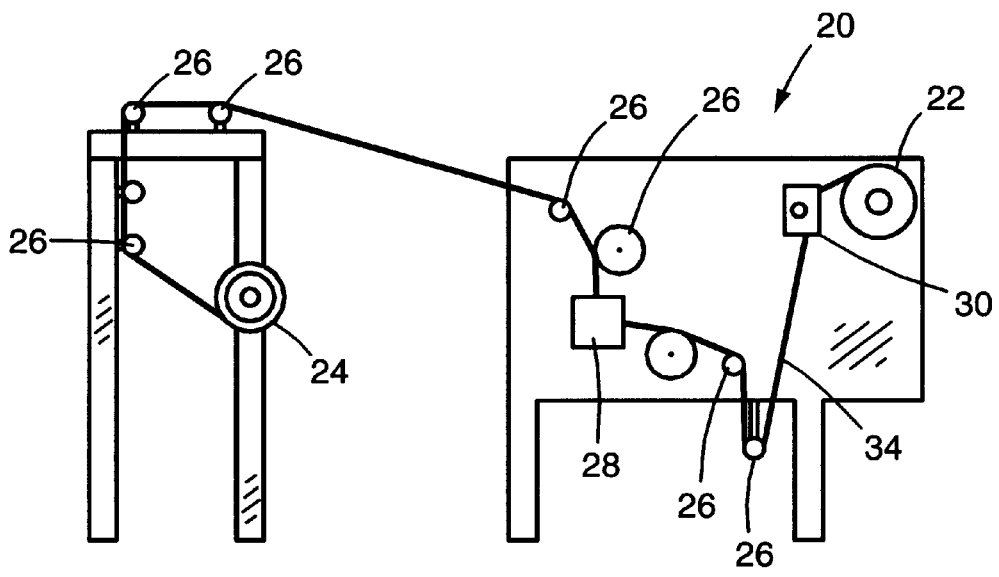
FIG. 1 is a side view of a well known prior art machine for texturizing fiber and wrapping it around a tubular member.

In describing the preferred embodiment of the invention which is illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose. For example, the word connected or terms similar thereto are often used. They are not limited to direct connection but include connection through other circuit elements where such connection is recognized as being equivalent by those skilled in the art.

Figure 2:
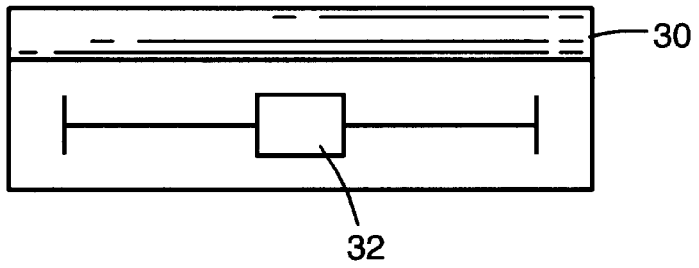
FIG. 2 is a front view of a texturized fiber feeder which is well known in the prior art.

Turning now to the drawings, FIG. 1 shows a prior art texturizer which texturizes fibers and then wraps the texturized fibers on a roll 22. A texturizer tangles, twists, or otherwise distorts a continuous filament to increase its bulk and give it a "spun-like" quality. The fibers start on a spindle 24, then go around a variety of rollers 26 to the texturizing jets 28 and through another variety of rollers 26 until reaching feeder 30. Feeder 30 is also represented in FIG. 2. Feeder 30 includes a shuttle 32 which moves back and forth across feeder 30 and serves to feed the texturized fiber 34 onto roll 22. Any of the currently available texturizer machines can be used in the context of this invention. The machine shown in FIGS. 1 and 2 is simply a representative model to give some background on the entirety of the procedure. The invention relates only to the wrapped roll and product. Thus, it is important that a texturizing machine which is selected for use in this application be one which feeds many strands of fiber simultaneously to be texturized as the yarn which is made should be of multiple strands.

Figure 3:
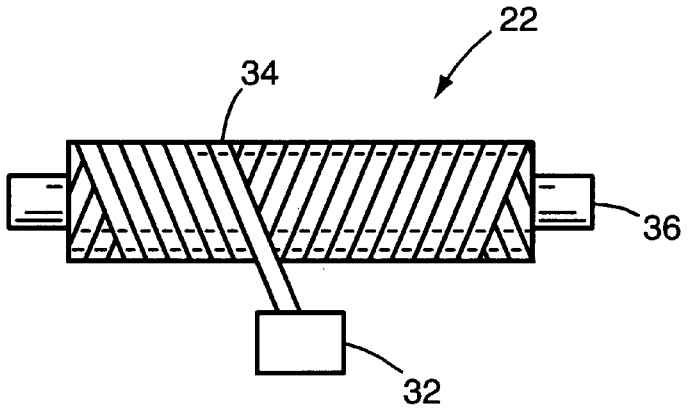
FIG. 3 is a front view of the silencer according to the present invention undergoing its first wrapping step.
Figure 4:
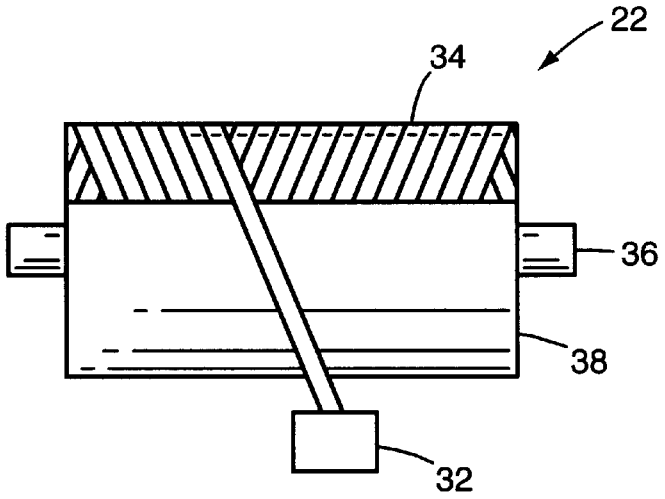
FIG. 4 is a front view of a silencer according to the present invention undergoing the first insertion of a septum.
Figure 5:
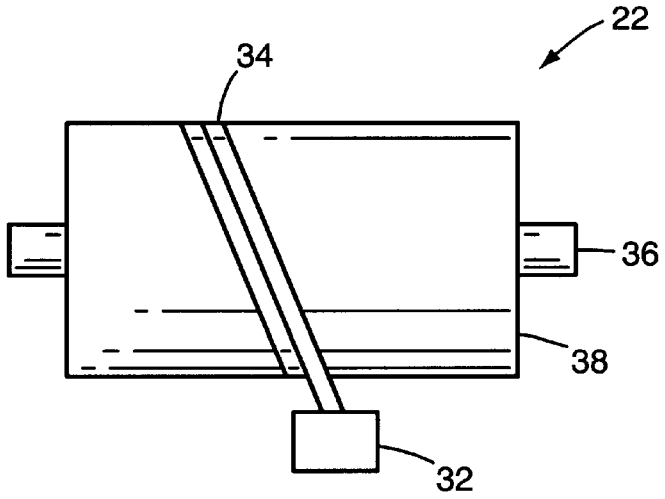
FIG. 5 is a front view of a silencer according to the present invention undergoing a second wrapping step.

The present invention relates only to the wrapping of texturized fiber and other materials into roll 22. However, because of the use of the roll 22 in the application of a silencer, the equipment required differs from that needed if a different application is anticipated. Turning to FIG. 3, texturized fiber yarn 34 is fed onto perforated tube 36 by means of shuttle 32. Perforated tube 36 is placed in well known fashion onto a mandril (not shown) which turns perforated tube 36 at an appropriate rate of speed. It is noted that while a perforated tube is preferred and most common for use with a standard muffler, a solid tube may also be used. The rate of speed on most machines is adjustable. Shuttle 32 moves back and forth along a path in feeder 30 and wraps the texturized fiber in continuous fashion across and back across perforated tube 36 as seen in FIG. 3. The speed of shuttle 32 is also adjustable. The texturized fiber yarn may be any material which is suitable for texturizing. However, it is most preferably fiberglass and most preferable e-glass, s-glass, or ecr-glass. Alternatively, it may be basalt mineral wool.

Figure 6:
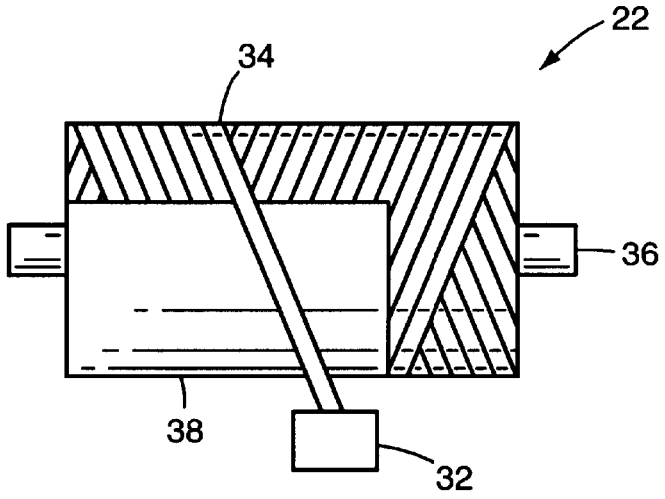
FIG. 6 is a silencer according to the present invention undergoing the second insertion of a septum.
Figure 7:
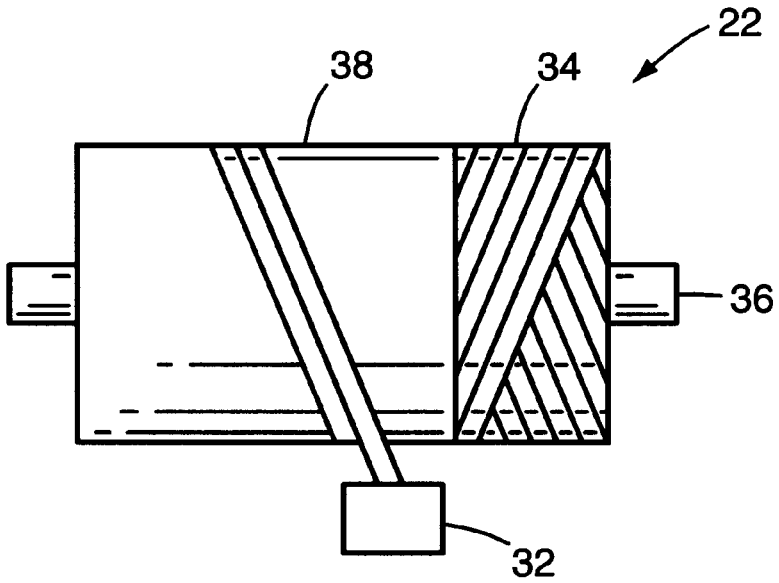
FIG. 7 is a silencer according to the present invention undergoing a third wrapping step.
Figure 8:
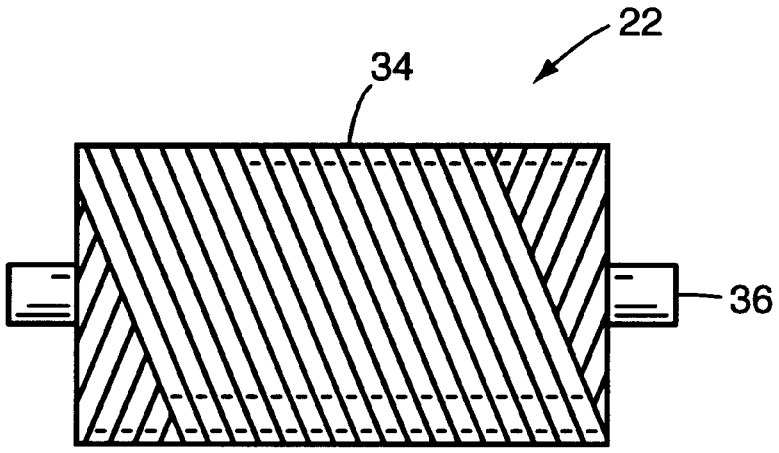
FIG. 8 is a front view of the perforated tube once all wrapping and insertion steps have been completed.

Turning now to FIGS. 4–7, the wrapping operation, i.e., the turning of perforated tube 36 and the oscillation of shuttle 32, are stopped. A septum 38 is then inserted under and around texturized glass 34. The septum 38 is a thin sheet of material. The most preferable materials are e-glass, ecr-glass, fiberglass, stainless steel wool or a perforated foil, ceramic paper, basalt paper, a composite basalt and fiberglass, or a vermiculite paper. The septum 38 should preferably be between about 1 mil and 3 mils thick. The operator will then manually turn perforated tube 36 such that the septum 38 is securely attached to the roll 22. Alternatively, the machine may simply be restarted slowly to allow the operator to view septum 38 and ensure its secure placement on first layer of texturized fiber 34. The septum 38 separates the texturized glass into a first layer and a second layer. The machine is then restarted and the second layer of texturized fiber is wrapped on top of septum 38. The silencer may then be complete. Alternatively, the turning of perforated tube 36 and the oscillation of shuttle 32 may again be stopped and a second septum 38 may be placed on top of the second layer of texturized fiber 34. As shown in FIG. 6, septum 38 need not extend the full length of the roll 22. Nor need it go around the entire circumference of roll 22. As shown in FIG. 7, the perforated tube 36 is again wound by hand to assure that the septum 38 is securely attached to roll 22. It is noted that instead of inserting septum 38 under texturized fiber 34 and rolling perforated tube 36 by hand that a user may instead sever texturized fiber 34 and resecure it in a variety of ways well known in the art, place septum 38 on top of roll 22 and then continue with the wrapping procedure as is well known in the art. FIG. 8 shows a completed roll 22 on perforated tube 36 fully wrapped in the third layer of texturized fiber 34. It is noted that it is preferable to end the wrapping procedure with texturized fiber 34 rather than a septum 38 for obvious reasons of stability. By using this system of rolling, one can achieve a density of up to 300 kilograms per cubic meter.

As mentioned earlier the prior art problem of fiber blow-out is greatly reduced by one or more septum layers because the septum layers prevent a direct path from the perforated exhaust tube 36 to the outlet tube at the downstream end of the muffler. In the path through the layered muffler of this invention the exhaust gases are deflected into a meandering path.

Figure 9:
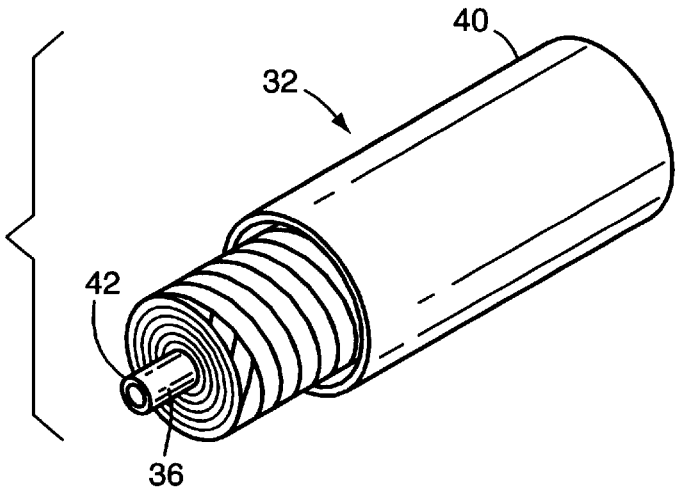
FIG. 9 is a perspective view of the perforated tube and wrapping being inserted into a canister.
Figure 10:
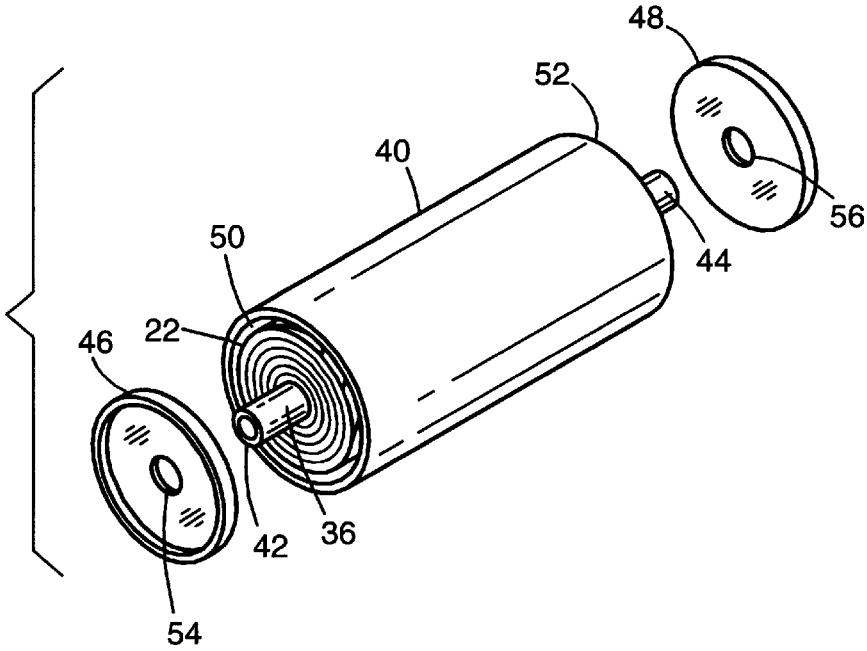
FIG. 10 is a perspective view showing a silencer according to the present invention wherein ends are placed on the canister.
Figure 11:
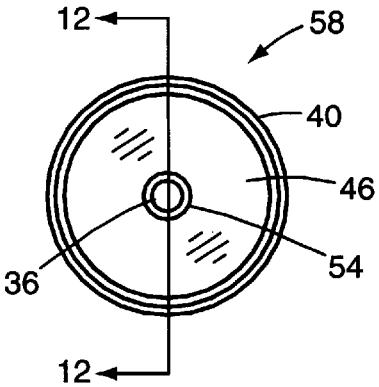

FIG. 9 shows the next step, i.e., the insertion of roll 22 into canister 40. Ideally, canister 40 will cover all of roll 22 but will not fully cover the ends of perforated tube 36. The reason is apparent when looking at FIG. 10. As shown in FIG. 10, end caps 46 and 48 are placed into the end openings 50,52 of canister 40. End caps 46,48 include apertures 54,56 which are of a shape and size adapted to allow ends 42,44 of perforated tube 36 to pass through apertures 54,56. FIG. 11 shows an end view of the fully put together silencer 58.

Figure 12:
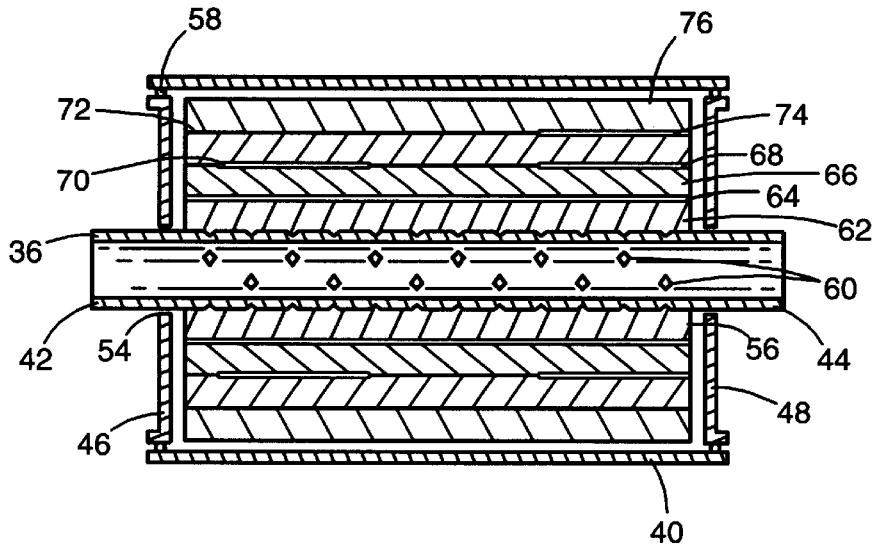
FIG. 12 is a sectional view of a completed silencer according to the present invention.

Turning to FIG. 12, the complete structure of the silencer becomes even more clear. The canister 40 is closed by caps 46,48 which accommodate ends 42,44 of perforated tube 36. FIG. 12 shows end caps 46,48 being secured to canister 40 by solder 58. However, the end caps may be secured to canister 40 by any means generally known in the art. Perforated tube 36 includes perforations 60. As is clearly shown, the first layer of texturized fiber 62 is covered by a first septum 64. In this case, first septum 64 covers the entire circumference and length of first layer 62. A second layer of texturized fiber 66 is then wrapped on top of the first layer of fiberglass 62 and first septum 64. Then there is placed two pieces of a second septum 68,70. It is noted that each piece 68,70 of the second septum wraps around the entire circumference of the second layer 66. However, neither extends the full length of second layer of texturized fiber 66. A third layer of texturized fiber 72 is then wrapped on top of the two pieces of second septum 68,70. A third septum 74 is then placed on the third layer of texturized fiber 72. Third septum 74 neither extends the full length nor the full circumference of the third layer of texturized fiber 72. A fourth layer of texturized fiber 76 is then wrapped on top of the third septum 74.

Figure 13:
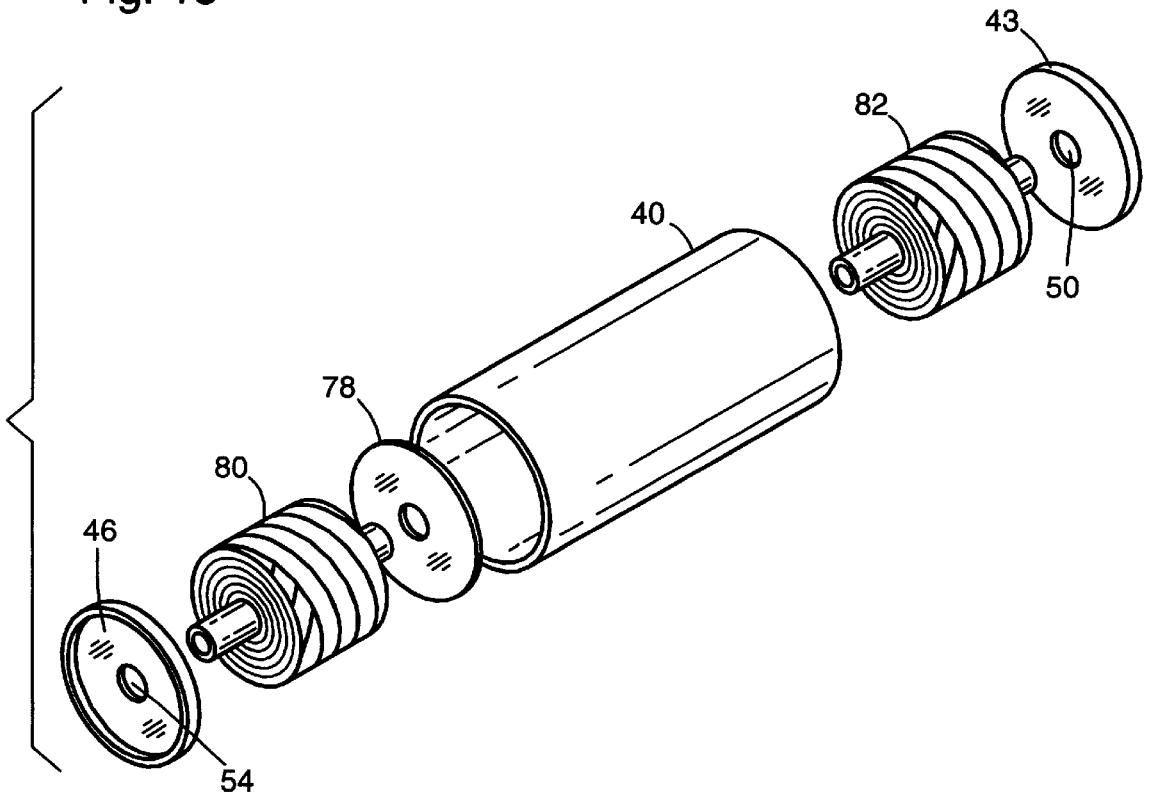
FIG. 13 is a perspective view showing the insertion of two perforated tubes with wrapping and a baffle into a canister and including the addition of end caps.
Figure 14:
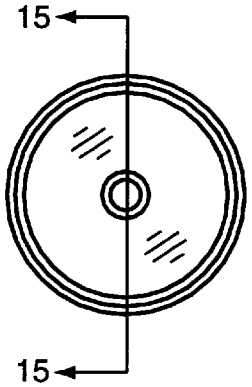
FIG. 14 is a side view of the silencer according to FIG. 13.
Figure 15:
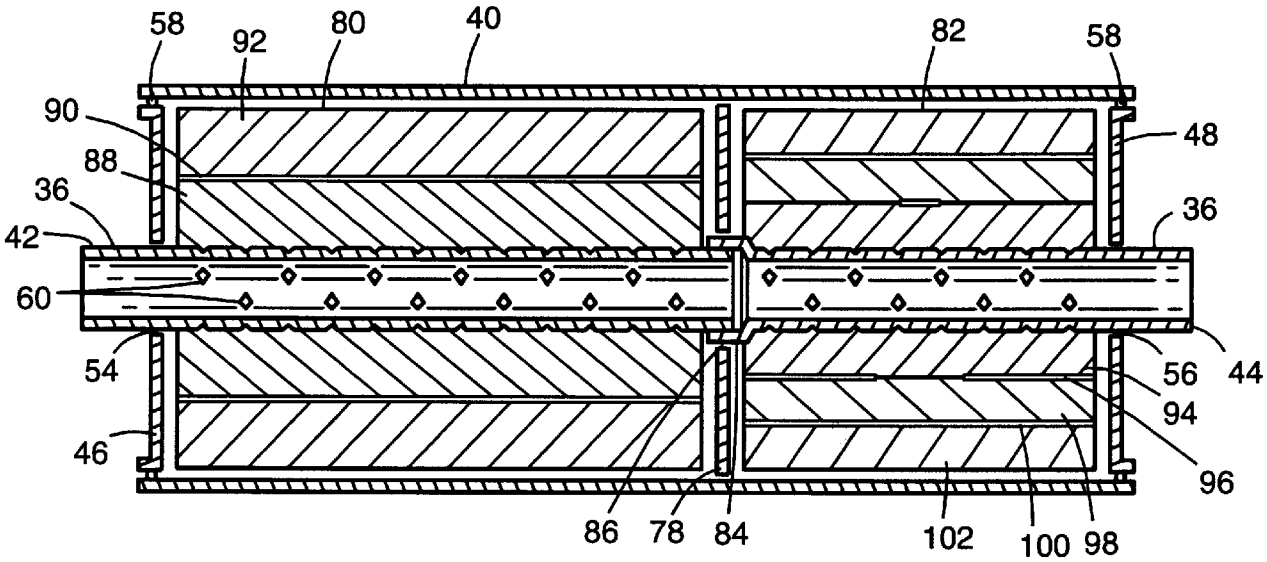
FIG. 15 is a sectional view of the silencer according to FIG. 13.

Turning now to FIGS. 13–15, it is apparent that many mufflers currently include a baffle 78. The baffle 78 must first be inserted into the canister 40 and a first roll 80 and a second roll 82 may be inserted on either side of the baffle. End caps 46 and 48 may then be secured to canister 40. As is shown in FIG. 15, baffle 78 may be closer to one of end caps 46,48. As also shown in FIG. 15, the perforated tube 36 of first roll 80 and second roll 82 may be provided with interlocking means 84 which will allow a simpler joining of first roll 80 and second roll 82 in canister 40 through aperture 86 through baffle 78. As is also shown in FIG. 15, there are numerous ways of wrapping each perforated tube 36. Any number of texturized fiber layers is permitted and each layer should be separated by a septum which extends at least part way across the length of the roll 22 and at least part way around the circumference of the layer of texturized fiber which it surrounds. Roll 80 shows only a first layer of texturized fiber 88, a first septum 90, and a second layer of texturized fiber 92. Roll 80 thus represents the simplest configuration of the roll of the present invention. Roll 82 shows a slightly more complex arrangement including a first layer of texturized fiber 94, a first septum 96 which is cut to an uneven shape, a second layer of texturized fiber 98, a second septum 100, and a third layer of texturized fiber 102. Any of these ways shown in the drawings and myriad other ways of wrapping texturized fiber and septums can be utilized to achieve the appropriate amount of sound dampening.

As will be apparent to one of ordinary skill in the art, the drawings shown represent only that the simplest version of a silencer in the form of a muffler for an automobile with a single pipe passing through the entirety of the silencer. As is known by one of ordinary skill in the art, mufflers may come with multiple pipes and in multiple sizes. One of ordinary skill in the art should easily be able to determine appropriate attachment mechanisms between any number of perforated tubes 36, any number of baffles 78, and any number of end caps 46,48 as they have not been changed for the present scope of this invention.

While certain preferred embodiments of the present invention have been disclosed in detail, it is to be understood that various modifications may be adopted without departing from the spirit of the invention or scope of the following claims.

I claim:

1. A method of making a silencer, comprising:

providing a perforated tube;

wrapping a first layer of texturized fiber around said tube;

stopping said wrapping of said first layer of texturized fiber;

covering at least a potion of said first layer of texturized fiber with at least one septum; and wrapping a second layer of texturized fiber around said at least one septum.

2. The method of making a silencer according to claim 1, further comprising stopping said wrapping of said second layer of texturized fiber and covering at least a portion of said second layer of texturized fiber with a second at least one septum.

3. The method of making a silencer according to claim 1, wherein said step of covering at least a portion of said first layer of texturized fiber with at least one septum comprises covering at least a portion of said first layer of texturized fiber with two septums.

4. The method of making a silencer according to claim 3, further comprising stopping said wrapping of said second layer of texturized fiber and covering at least a portion of said second layer of texturized fiber with a third septum.

5. The method of making a silencer according to claim 1, wherein said wrapping step comprises wrapping said first layer of texturized fiber to a density up to 300 $kg/m^3$ to allow volumetric air flow.

6. A method of making a silencer, comprising:

providing a perforated tube;

wrapping a first layer of texturized fiber around said tube;

stopping said wrapping of said first layer of texturized fiber;

covering at least a potion of said first layer of texturized fiber with two septums.

7. The method of making a silencer according to claim 6, further comprising wrapping a second layer of texturized fiber around said two septums.

8. The method of making a silencer according to claim 7, further comprising stopping said wrapping of said second layer of texturized fiber and covering at least a portion of said second layer of texturized fiber with a third septum.

9. The method of making a silencer according to claim 6, wherein said wrapping a first layer stpe comprises wrapping said first layer of texturized fiber to a density up to 300 $kg/m^3$ to allow volumetric air flow.

* * * * *